US007938286B2

(12) United States Patent
Vogel et al.

(10) Patent No.: US 7,938,286 B2
(45) Date of Patent: May 10, 2011

(54) CONTAINER SYSTEM

(75) Inventors: William C. Vogel, Mequon, WI (US); Terrence M. Parve, Menomonee Falls, WI (US)

(73) Assignee: Gateway Plastics, Inc., Mequon, WI (US)

( * ) Notice: Subject to any disclaimer, the term of this patent is extended or adjusted under 35 U.S.C. 154(b) by 1012 days.

(21) Appl. No.: 11/706,848

(22) Filed: Feb. 13, 2007

(65) Prior Publication Data

US 2008/0190930 A1 Aug. 14, 2008

(51) Int. Cl.
*B65D 17/34* (2006.01)
*B65D 25/28* (2006.01)
*B65D 43/10* (2006.01)

(52) U.S. Cl. ..... 220/276; 220/270; 220/760; 220/773; 220/755; 220/784

(58) Field of Classification Search ..... 220/276, 220/270, 784, 760, 775, 776, 773, 755
See application file for complete search history.

(56) References Cited

U.S. PATENT DOCUMENTS

| | | | | |
|---|---|---|---|---|
| 1,664,308 | A | | 3/1928 | Miller |
| 2,823,829 | A | | 2/1958 | Frater |
| 3,586,200 | A | | 6/1971 | Kramer et al. |
| 3,623,651 | A | | 11/1971 | Marcan |
| 3,710,975 | A | | 1/1973 | Jansen |
| 3,759,416 | A | | 9/1973 | Constantine |
| 3,873,017 | A | | 3/1975 | Blatt |
| 4,026,458 | A | | 5/1977 | Morris et al. |
| 4,081,124 | A | | 3/1978 | Hall |
| 4,113,095 | A | | 9/1978 | Dietz et al. |
| 4,127,915 | A | | 12/1978 | Logan et al. |
| 4,167,232 | A | | 9/1979 | Munk et al. |
| 4,194,626 | A | | 3/1980 | Boller |
| 4,316,540 | A | | 2/1982 | Lapham |
| 4,332,332 | A | | 6/1982 | Ingemann |
| 4,341,338 | A | | 7/1982 | Arnold |
| 4,576,330 | A | | 3/1986 | Schepp |
| D284,728 | S | | 7/1986 | Trivison |
| 4,625,876 | A | * | 12/1986 | Bullock, III ..... 215/256 |
| 4,691,834 | A | * | 9/1987 | Bullock, III ..... 215/232 |
| 4,735,337 | A | | 4/1988 | Von Holdt |
| 4,756,425 | A | | 7/1988 | Wise |

(Continued)

FOREIGN PATENT DOCUMENTS

AU 17854/95 11/1995

(Continued)

OTHER PUBLICATIONS

Letter from VedderPrice P.C., dated Feb. 16, 2011, 2 pages.

*Primary Examiner* — Anthony Stashick
*Assistant Examiner* — Niki M Eloshway
(74) *Attorney, Agent, or Firm* — Foley & Lardner LLP

(57) ABSTRACT

A container that may be used for retaining and dispensing matter is provided. The container includes a closure having a downwardly depending skirt with a plurality of space apart vertical projections supported at an inside surface of the skirt. The projections are configured to releasably engage an open end of the container for securing the closure to the container. The projections include a guide surface for guiding the projections over the open end of the container and a retaining surface for retaining the projections on the container.

32 Claims, 7 Drawing Sheets

U.S. PATENT DOCUMENTS 4,798,301 A 1/1989 Bullock et al.
4,804,092 A 2/1989 Jones
4,874,088 A 10/1989 Leben
4,930,656 A 6/1990 Blanchette
4,934,557 A 6/1990 Smith
4,976,369 A * 12/1990 Shindo et al. ..... 220/270
5,012,928 A 5/1991 Proffitt et al.
5,083,699 A 1/1992 Bulcher
5,106,015 A 4/1992 Vlasaty et al.
5,145,088 A 9/1992 Goujon
D332,917 S 2/1993 McDevitt et al.
5,199,571 A 4/1993 Wolff et al.
D336,850 S 6/1993 Guillin
5,224,617 A 7/1993 Gaudreault
5,226,553 A * 7/1993 Fiore ..... 220/318
5,261,537 A 11/1993 Shindo et al.
D342,609 S 12/1993 Brightbill
D343,576 S 1/1994 Krupa
D343,795 S 2/1994 Verchere
5,303,839 A 4/1994 Blumenschein
D348,130 S 6/1994 Miller
D350,632 S 9/1994 Cummins
D352,143 S 11/1994 Arshinoff
5,377,858 A 1/1995 Morris, Sr.
D358,327 S * 5/1995 Tomasello ..... D9/424
D361,892 S 9/1995 Quaintance
5,485,951 A 1/1996 Phillips
D367,760 S 3/1996 Zimmerman
5,503,275 A 4/1996 Fesquet
5,579,556 A * 12/1996 Chung ..... 16/110.1
5,617,968 A 4/1997 Luburic
D379,122 S 5/1997 Wolff
5,626,251 A 5/1997 Luburic et al.
D383,670 S 9/1997 Gubeli
D384,502 S 10/1997 Seager et al.
D387,558 S 12/1997 Mann et al.
5,697,548 A 12/1997 Halsell, II
D391,079 S 2/1998 Conti et al.
5,718,350 A 2/1998 Williams
D397,552 S 9/1998 Rutledge
D398,151 S 9/1998 Ahern, Jr.
5,816,439 A 10/1998 Lovell et al.
5,816,674 A 10/1998 Manos et al.
5,823,345 A 10/1998 Nask et al.
5,833,115 A 11/1998 Eiten
D406,463 S 3/1999 Rutledge
5,896,993 A 4/1999 Nask et al.
5,941,408 A 8/1999 Sherman
D416,794 S 11/1999 Cormack
5,979,690 A 11/1999 Hartley
6,062,388 A 5/2000 Ohayon
6,093,460 A 7/2000 Iwaya
RE36,867 E 9/2000 Rozzano
D430,800 S 9/2000 Sarnoff
D431,362 S 10/2000 Conti
D439,839 S 4/2001 Wolf et al.
6,257,438 B1 7/2001 Von Holdt, Jr.
6,257,440 B1 7/2001 Perkins et al.
6,269,967 B1 8/2001 De Vries
D448,991 S 10/2001 Zettle et al.
6,367,645 B1 4/2002 Trygg
6,494,341 B2 12/2002 Perkins et al.
D470,048 S 2/2003 Buchalski et al.
D473,137 S 4/2003 Cadiente et al.
6,588,612 B1 7/2003 Dorn et al.
6,651,874 B1 11/2003 Pedersen
6,688,483 B2 2/2004 Davis
6,779,676 B2 8/2004 Ciccone
D514,390 S 2/2006 Palder
7,073,680 B2 7/2006 Boback et al.
D526,481 S 8/2006 Dong
D528,374 S 9/2006 Heiberg et al.
D529,798 S 10/2006 Snedden et al.
7,134,567 B2 11/2006 Luburic
7,467,730 B2 * 12/2008 Manke et al. ..... 220/760
7,475,788 B2 * 1/2009 Schwarz ..... 220/276
2001/0027980 A1 10/2001 Perkins et al.
2002/0092791 A1 7/2002 Wnek
2002/0134783 A1 * 9/2002 Arshinoff ..... 220/270
2002/0148834 A1 * 10/2002 Luburic ..... 220/270
2003/0015530 A1 1/2003 Shepler
2003/0116577 A1 6/2003 Slongo et al.
2003/0121917 A1 7/2003 Fore et al.
2003/0189048 A1 10/2003 Luburic
2004/0060942 A1 4/2004 Luburic
2004/0079757 A1 4/2004 Ciccone
2004/0118737 A1 6/2004 Welsh et al.
2004/0146602 A1 7/2004 Garwood et al.
2004/0195251 A1 10/2004 von Holdt, Jr.
2004/0206766 A1 10/2004 Law
2004/0244169 A1 12/2004 Crawley
2005/0133521 A1 6/2005 Schwartz
2005/0145628 A1 7/2005 Schwarz
2005/0279654 A1 12/2005 Robles
2006/0027581 A1 2/2006 Vogel et al.
2006/0027587 A1 2/2006 Nottingham et al.
2006/0043098 A1 3/2006 Backes
2006/0102638 A1 5/2006 Summerfield
2006/0163265 A1 * 7/2006 De Candido ..... 220/784
2006/0175334 A1 * 8/2006 Schwarz ..... 220/276
2006/0186014 A1 8/2006 Ramanujam et al.
2006/0219593 A1 10/2006 Linz

FOREIGN PATENT DOCUMENTS

EP 371 565 B1 6/1990
WO WO 02/30780 A1 4/2002

* cited by examiner

CONTAINER SYSTEM

BACKGROUND

The present disclosure relates to a container. The present disclosure more specifically relates to a container for retaining matter and for dispensing the matter.

It is known to provide for containers that may be used for retaining and dispensing matter. Such known containers do not realize certain advantageous features and/or combination of features of the container disclosed herein.

SUMMARY

One embodiment relates to a closure for a container including a top portion having an outer edge, a skirt downwardly depending from the outer edge and having an inside surface and a lower edge, and a plurality of space apart projections supported at the inside surface of the skirt and extending in a substantially vertical direction. The projections are configured to releasably engage an open end of the container for securing the closure to the container.

Another embodiment relates to a container in combination with the closure recited above.

Another embodiment relates to a closure for a container including a top portion having an outer edge, a skirt downwardly depending from the outer edge and having a lower edge, and a tear strip removably coupled to the lower edge of the skirt. The tear strip has a first end and a second end. The closure also includes first and second pull tabs. The first pull tab is coupled to the first end of the tear strip and the second pull tab is coupled to the second end of the tear strip. The closure further includes at least one frangible link releasably coupling the first pull tab to the second pull tab. The at least one frangible link provides a substantially continuous transition between at least one of an upper edge of the first pull tab and an upper edge of the second pull tab and a lower edge of the first pull tab and a lower edge of the second pull tab. The first and second pull tabs are offset outwardly from the skirt and the tear strip.

Another embodiment relates to a container for use with a closure having a removable strip with at least one pull tab. The container includes a side wall having an upper end and a lower end, an end wall provided at the lower end of the side wall, a satellite ring disposed around the upper end of the side wall. The satellite ring has a top surface configured to be vertically offset from a lower edge of the removable tear strip. The container also includes a lift handle configured to be positioned under the at least one pull tab of the removable tear strip. The lift handle has a top surface slanting inward towards the side wall. A portion of the satellite ring is missing at the top surface of the lift handle to provide clearance for a user trying to grasp the at least one the pull tab.

Another embodiment relates to a handle for a container. The handle comprises a bail, a gripping portion integrally formed with the bail with an outer gripping surface that substantially conceals an inner support structure, and at least one stiffening projection extending between the bail and the gripping portion.

DETAILED DESCRIPTION

Figure 1:
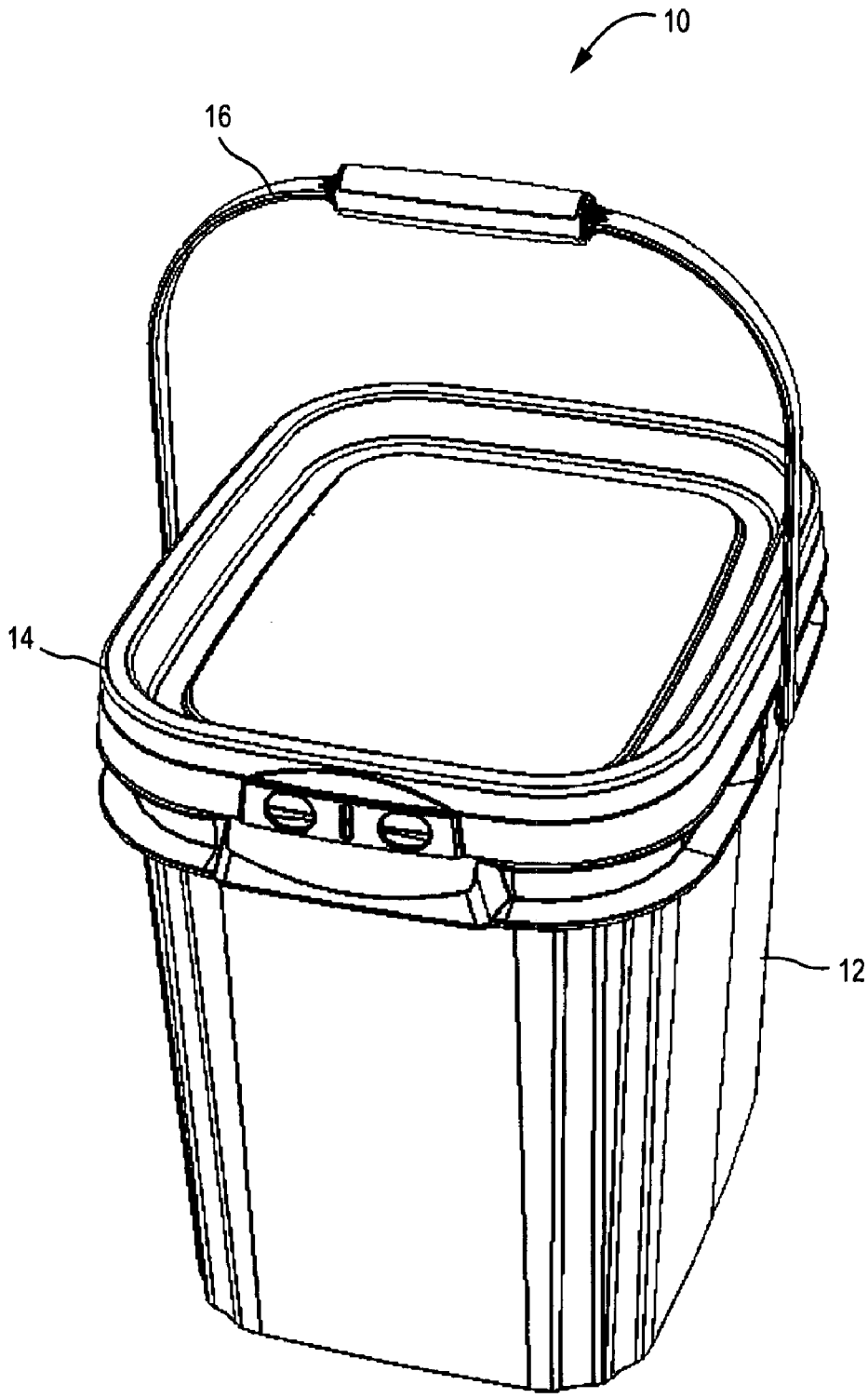
FIG. 1 is a perspective view of a container having a receptacle and a closure according to an exemplary embodiment.

Referring generally to the FIGS., a container 10 is shown according to an exemplary embodiment. Container 10 may be provided for receiving, holding, storing, transporting, and dispensing various matters or substances, in particular, granular or particulate matter (e.g., pet food, cat litter, etc.). Container 10 may also be provided for use with other types of matter such as liquids, chemicals, or any other viscous materials or fluids. Container 10 generally comprises a receptacle (e.g., bottom portion, bottle, bucket, etc.), shown as a pail 12, a closure (e.g., top portion, cap, lid, etc.), shown as a cover 14, and a lifting device (e.g., strap, holder, etc.), shown as a handle 16.

Referring to FIGS. 1-4, pail 12 is shown according to an exemplary embodiment. Pail 12 is configured to receive, hold, store, transport, etc. a wide variety of different materials and substances. According to the embodiment illustrated, pail 12 generally includes a plurality of side walls 20 and a bottom 30. Side walls 20 extend upward from bottom 30 to form an open container. Side walls 20 are shown as being substantially flat and rigid panels or members that extend generally perpendicularly from the periphery of bottom 30 to form a substantially rectangular shaped tube that is closed on one end by bottom 30 and open at an opposite end.

The intersection between adjacent sidewalls 20 (e.g., the "corners" of pail 12) include structural features, shown as corrugations 22, intended to resist deformation due to axial loading of pail 12. According to the embodiment illustrated, corrugations 22 extend vertically from the lower end of side wall to just below a lower satellite ring of a collar 40 (detailed below). Corrugations 22 strengthen side walls 20 and reduce the likelihood of crushing or other deformation from a force applied to the top of bottom of container 10 (e.g., when multiple containers 10 are stacked atop each other by having a closure of the bottom container support the receptacle of the top container).

Figure 3:
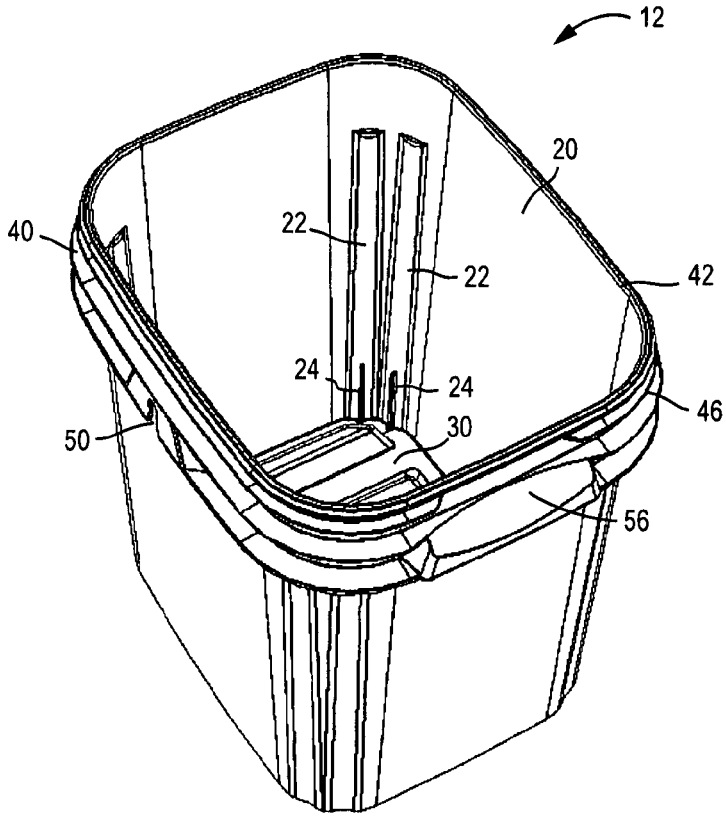
FIG. 3 is another perspective view of the container of FIG. 1 showing an inside of the receptacle.

In addition to container 10 being stackable with another container 10, pail 12 is also configured to be stackable with another pail 12 so that a first pail 12 can be stacked inside a second pail 12. Such a design may allow empty pails to be efficiently transported, stored and/or incorporated into an assembly process before being filled with a product. Referring to FIG. 3 in particular, pail 12 includes one or more denesting projections (e.g., fins, etc.), shown as a plurality of ribs 24, to facilitate the separation of a first pail 12 stacked within a second pail 12. Ribs 24 are provided on the inside of pail 12 at the intersection of side walls 20 (e.g., the lower corners of pail 12, etc.). Ribs 24 assist in separating one pail 12 from another when they are stacked on inside the other by ensuring that an air gap is provided between an inside surface of a side wall 20 of a bottom pail 12 and an outside surface of a side wall 20 of a top pail 12. Ribs 24 may also be configured to prevent a pail 12 from being fully inserted into another pail 12. According to the embodiment illustrated, each corner of pail 12 includes a pair of ribs 24. Such ribs 24 project inward toward the inside of pail 12 and extend upward in a substantially vertical direction in a lower portion of pail 12.

Figure 4:
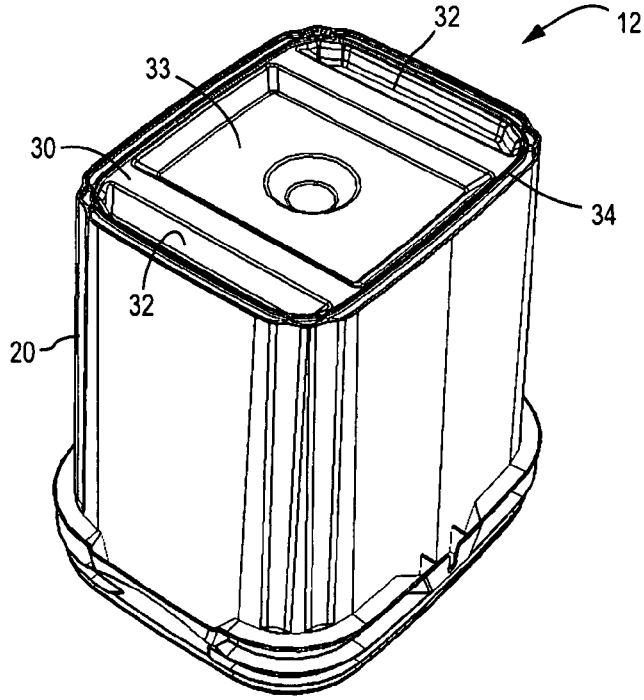
FIG. 4 is another perspective view of the container of FIG. 1 showing a bottom of the receptacle.

Referring FIG. 4 in particular, bottom 30 of pail 12 is shown as being a generally flat, rectangular panel. Bottom 30 and/or side walls 20 may include one or more indentations (e.g., recesses, concave areas, wells, etc.) that facilitate the handling of pail 12 by a user. According to an exemplary embodiment, bottom 30 includes one or more indentations 32 that are configured and located such that a user may insert his or her fingers into recesses 32 as he or she picks up pail 12 or tips it one way or the other, such as to pour out the contents of pail 12. According to embodiment illustrated, bottom 30 includes a pair of relatively symmetric recess 32 (e.g., one at each short side of pail 12, etc.) so that a recess in available to a user regardless of what end of pail 12 a user wishes to pour or dispense the contents of pail 12 from. Recess 32 are shown as being separated from each other by a central indentation or recess 33 that may further simply the handling of pail 12 by a user.

To further assist a user in the handling of container 10, bottom 30 may further include a lip (e.g., rib, etc.), shown as a rim 34 around the periphery of bottom 30 that a user may grasp when handling pail 12 or pouring the contents of pail 12. Rim 34 may also cooperate with a corresponding feature in cover 14 (detailed below) to facilitate the stacking of one container 10 on another container 10.

Referring again to FIG. 2, pail 12 is further shown as comprising a reinforcement member (e.g., structural band, etc.), shown as a collar 40, for increasing the hoop strength of pail 12 and/or providing a structure to which cover 14 may be coupled. Collar 40 is provided at the upper end of sidewalls 20 (i.e., the open end of sidewalls 20 opposite bottom 30) and extends at least partially around the periphery of pail 12. According to an exemplary embodiment, collar 40 includes a rim or lip 42, one or more tear strip engaging projections 44, a first satellite ring 46 and a second satellite ring 47.

Lip 42 and projection 44 are features (e.g., rims, flanges, protrusions, etc.) that are provided, at least in part, to facilitate the releasable (e.g., movable, removable, pivotable, etc.) coupling of cover 14 to pail 12. Lip 42 extends outward from the upper edge of pail 12. According to the embodiment illustrated, lip 42 extends continuously in a generally horizontal orientation around the upper edge of pail 12. Lip 42 is configured to releasably engage a corresponding feature on cover 14 (e.g., one or more vertical ribs or undercuts, etc.) to assist in retaining cover 14 in a closed position. Lip 42 is shown as having a substantially circular cross-sectional profile, but according the various alternative embodiments may have any of a number of suitable cross-sectional profiles (e.g., polygonal, curvilinear, combinations thereof, etc.). According to further alternative embodiments, lip 42 may extend discontinuously (e.g., intermittently, etc.) around the upper edge of pail 12 and/or having a varying cross-sectional profile around the upper edge of pail 12. For example, lip 42 may be provided only in the corners of pail 12 and/or enlarged in the corners of pail 12.

Projection 44 also extends outward from pail 12, but is offset vertically from lip 42 in a downward direction such that projection 44 is provided between lip 42 and second satellite ring 47. Projection 44 extends around the periphery of pail 12 in a direction (i.e., a horizontal direction) that is substantially parallel to lip 42 and second satellite ring 47. Similar to lip 42, projection 44 engages a corresponding feature on cover 14 to assist in securing cover 14 to pail 12. As detailed below, projection 44 is configured engage a corresponding feature on a removable tear strip of cover 14 to assist in securing cover 14 to pail 12.

According to the embodiment illustrated, an aperture (e.g., missing portion, cutout, recess, etc.), shown as a gap 45, is provided in projection 44 at what is intended to be the front of container 10. While not shown, a second gap in projection 44 may be provided at what is intended to be the back of container 10. Gap 45 may advantageously simplify the removal of cover 14 from pail 12 for a user. For example, gap 45 may provide additional clearance between an outside surface of pail 12 and an inside surface of cover 14. Such clearance may allow a user to more easily get his or her fingers around the end of a tear strip (if provided) that must be removed before container 10 is opened and/or may allow a user to more easily grasp a portion of cover 14 (e.g., a skirt portion, etc.) to move cover 14 into an open position.

According to the various alternative embodiments, projection 44 may extend continuously around the periphery of pail 12 or may include one or more apertures in locations other than where is shown. According to further alternative embodiments, projection 44 may be eliminated from pail 12 entirely. For example, if cover 14 does not include a removable tear strip, projection 44 may not be needed in the situation where projection 44 is provided solely as a coupling structure for a removable tear strip.

Figure 2:
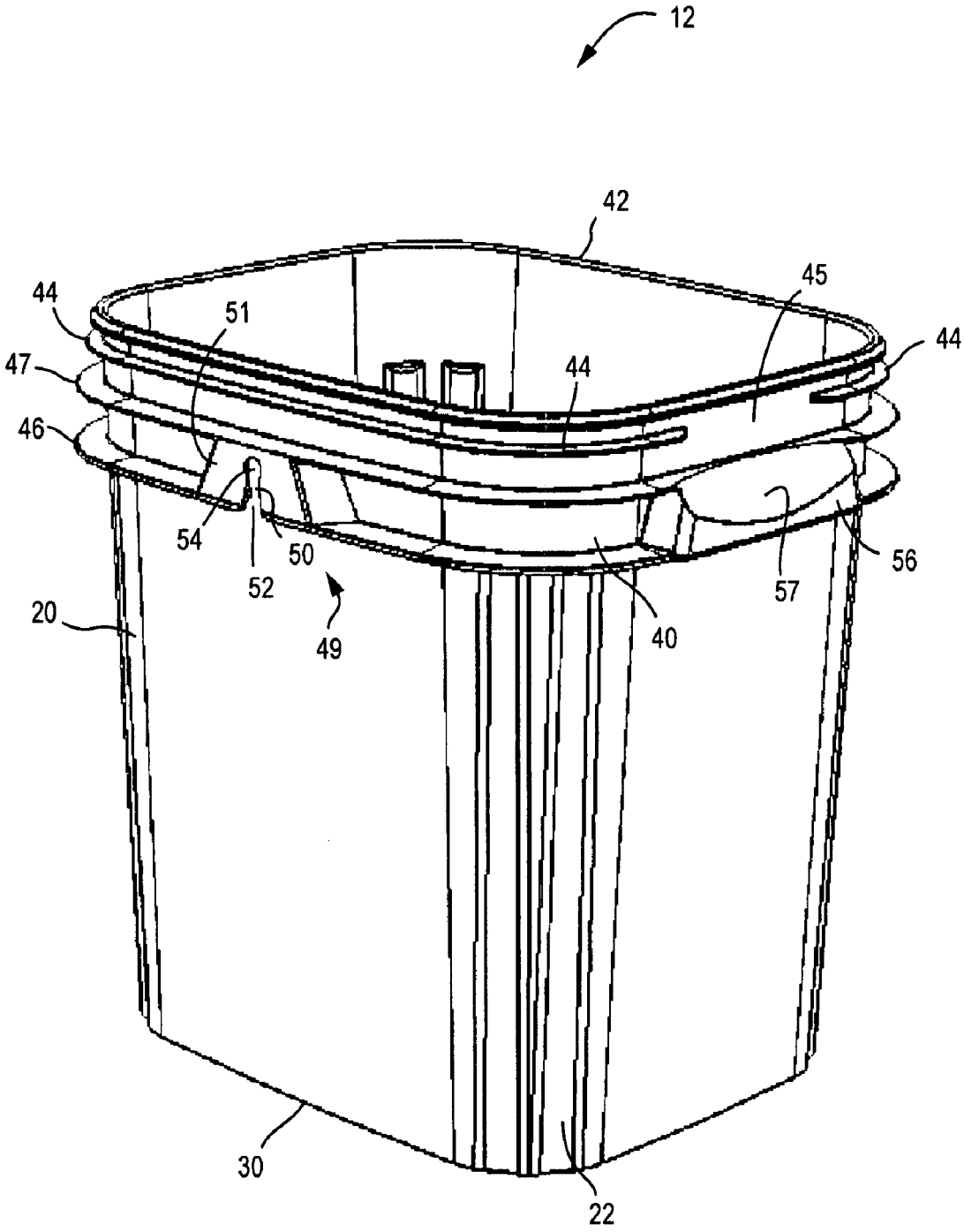
FIG. 2 is a perspective vie w of the container of FIG. 1 shown without the closure.

Still referring to FIG. 2, first satellite ring 46 and second satellite ring 47 are additional features that extend outward from pail 12 and generally extend around the circumference of pail 12. According to an exemplary embodiment, first satellite ring 46 is a lower satellite ring and second satellite ring 47 is an upper satellite ring. The two satellite rings are generally parallel to each other and are provided to, at least in part, increase the strength of pail 12 (e.g., the hoop strength, etc.). According to the embodiment illustrated, first satellite ring 46 and second satellite ring 47 do not interfere with the coupling of cover 14 to pail 12. For example, neither first satellite ring 46 nor second satellite ring 47 come into contact with cover 14 when cover 14 is coupled to pail 12. As detailed below, a gap exits between second satellite ring 47 and the lowermost edge of cover 14 (e.g., a lower edge of a removable tear strip, etc.). Without contacting cover 14, second satellite ring 47 may be better positioned to reduce the likelihood of cover 14 becoming inadvertently removed from pail 12. For example, positioning second satellite ring 47 beneath a lower edge of a removable tear strip, with a slight gap therebetween, and extending second satellite ring 47 outward beyond the periphery of the tear strip (see FIG. 6) reduces the likelihood that an object will engage the tear strip and cause an inadvertent removal.

Formed or otherwise integrated with first satellite ring 46 and second satellite ring 47 are various features that may assist in the handling of container 10 for a user. According to an exemplary embodiment, a pair of handle support structures 49 and one or more lift handles 56 are supported by first satellite ring 46 and second satellite ring 47. Handle support structures 49 are shown as being provided on opposite sides of pail 12 (e.g., long sides, etc.) and are configured to receive a portion of handle 16 for securing handle 16 to pail 12. Handle support structures 49 include at least one wall extending between first satellite ring 46 and second satellite ring 47. According to the embodiment illustrated, a front wall 51 for each support structure extends between the outer edges of first satellite ring 46 and second satellite ring 47 and defines an aperture (e.g., opening, recess, channel, etc.), shown as a notch 50, configured to receive the free end of handle 16. Notch 50 includes a slot 52 and a circular opening 54. Slot 52 extends from the bottom edge of front wall 51 with a width that narrows in an upwardly vertical direction. Circular opening 54 is provided on the upper side of slot 52.

One or more lift handles 56 may also be provided along collar 40 to provide a structure that allows a user to conveniently lift container 10 in a vertical direction without using handle 16 and/or that assists in the pouring of the product out of container 10. According to an exemplary embodiment, a pair of lift handles 56 are provided at opposite sides (e.g., the short sides, etc.) of pail 12. Lift handles 56 are positioned between first satellite ring 46 and second satellite ring 47 so that the lower edge of lift handles 56 are defined by first satellite ring 46 and the upper edge of the lift handles 56 are defined by second satellite ring 47.

According to an exemplary embodiment, at least one lift handle 56 includes an upper surface 57 that is angled or otherwise slanted (e.g., sloped, etc.) at an inwardly orientation so that a top portion of lift handle 56 has a diminished depth relative to a bottom portion of lift handle 56. To provide for such a configuration, upper surface 57 may be a substantially linear surface (e.g., beveled, chamfered, etc.), may be a curved surface (e.g., parabolic, etc.) or may include both linear and curvilinear portions. According to the embodiment illustrated, the lift handle 56 that is provided on the intended front of container 10 and positioned directly beneath a starting point of a tear strip (see FIG. 1) includes an angled upper surface 57. To further reduce the depth of the top portion of lift handle 56, a portion of second satellite ring 47 is cutout or otherwise missing. Providing lift handle 56 with such a configuration in such a position advantageously provides additional clearance for the hand of a user attempting to remove the tear strip from cover 14.

Referring now to FIGS. 5-9, cover 14 is shown according to an exemplary embodiment. Cover 14 is provided for generally protecting, sealing, enclosing, and/or selectively closing an open end of pail 12 to retain or selectively retain the contents of pail 12 within pail 12. Cover 14 generally includes a top portion 64, a skirt, shown as a plurality of side walls 60, and a tear strip 70. According to the embodiment illustrated, cover 14 is a "dust cover" configured to move between a closed position and an open position by being completely removed from pail 12. According to the various alternative embodiments, cover 14 may include one or more portions that are moveable in a manner that does not require cover 14 to be completely and/or partially removed from pail 12 in order to achieve the open position. For example, cover 14 may include one or more flaps movable in a pivotal manner and configured to selectively conceal an opening allowing access to the contents of pail 12.

Figure 5:
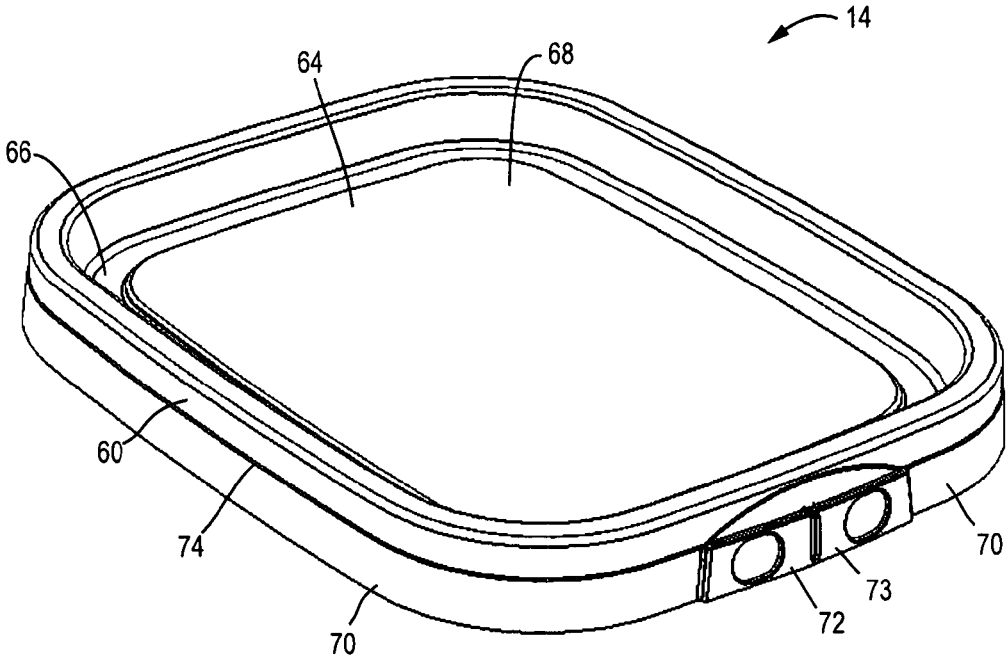
FIG. 5 is a perspective view of the closure of FIG. 1 shown without the receptacle.

Referring to FIG. 5 in particular, top portion 64 is coupled to an upper end of side walls 60 of cover 14 to form a generally rectangular, cup-shaped member that has its opening facing pail 12. Top portion 64 is generally flat and may be configured to receive bottom 30 of a like pail 12 that may be stacked on top of cover 14. To facilitate this stacking, top portion 64 may include a recess 66 (e.g., channel, recess, groove, indent, etc.) and a raised region 68 (e.g., shelf, ledge, boss, etc.) that cooperates with rim 34 on bottom 30 of pail 12.

Referring further to FIG. 5, side walls 60 of cover 14 generally form the outer periphery of cover 14 and are configured to be coupled to side walls 20 (or collar 40) of pail 12 (e.g., generally in the region of collar 40). According to the embodiment illustrated, side walls 60 maintain substantially the same height as they extend around the periphery of cover 14. According to various alternative embodiments, the height of side walls 60 may vary along the periphery of cover 14. For example, it may be desirable to increase and/or decrease the height of side walls 20 in certain areas (e.g., one or more corners, etc.) to assist a user in removing cover 14 from pail 12.

Figure 6:
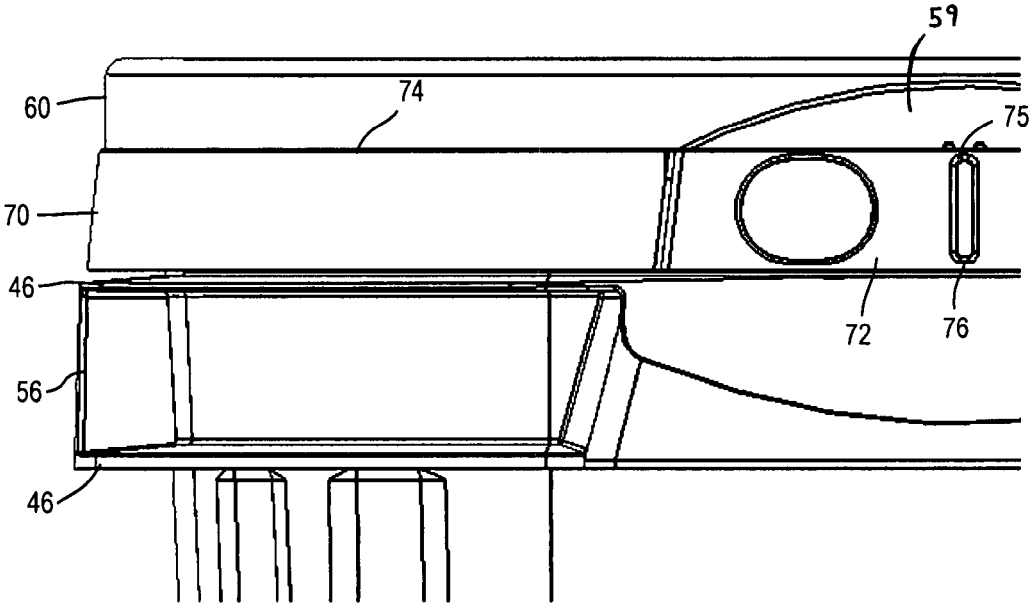
FIG. 6 is a partial front elevation view of the closure coupled to the receptacle.

In addition to the height of side walls 60 remaining relatively constant around the periphery of cover 14, the orientation (e.g., planar orientation, etc.) of side walls 60 remains relatively constant around the periphery of cover 14. As best shown in FIG. 6, side walls 60 extend downward in a substantially vertical direction relative to top portion 64. Side walls 60 may include one or more portions having an orientation that is inconsistent with the remaining portions of side walls 60. According to an exemplary embodiment, side wall 60, at the intended front portion of container 10, includes an arcuate portion 59 that projects outwardly relative to the remaining portions of side wall 60. Arcuate portion 59 is the portion of side wall 60 that the manufacturer of container 10 would like a user to lift when attempting to remove cover 14 from pail 12. This may be a point along cover 14 that requires the least amount of force to open cover 14 (i.e., an optimum lift point). By projecting arcuate portion 59 outward from the remaining portions of side wall 60, the attention of the user will preferably be visually drawn to this area as being the intended lift point. Various indicia (e.g., nomenclature, arrows, etc.) may also be used to direct the attention of the user. According to the embodiment illustrated, arcuate portion 59 is positioned above a starting point for tear strip 70.

Tear strip 70 is a strip of material that is configured to be removed from cover 14 by the user prior to his or her opening of container 10. Before being removed, tear strip 70 assists in securing cover 14 to pail 12 to reduce the likelihood of tampering and/or the inadvertent removal or dislodgement of cover 14. According to an exemplary embodiment, tear strip 70 extends downward from the bottom edge of side walls 60 and extends all or a portion of the circumference of cover 14. Tear strip 70 may be substantially coplanar with side walls 60 (e.g., extend downward in a substantially vertical direction, etc.) or may be orientated within a different plane. According to the embodiment illustrated, tear strip 70 is angled downwardly and outwardly (i.e., flared) relative to side walls 60 (shown in FIG. 6).

Figure 7:
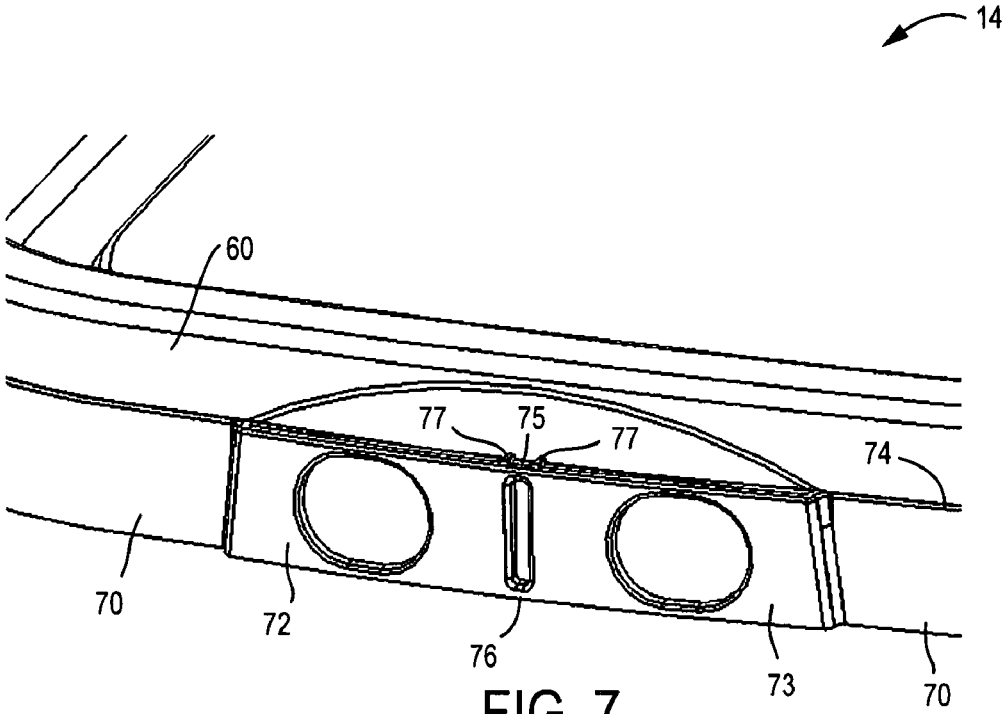
FIG. 7 is a detailed partial perspective view of the closure of FIG. 1.
Figure 8:
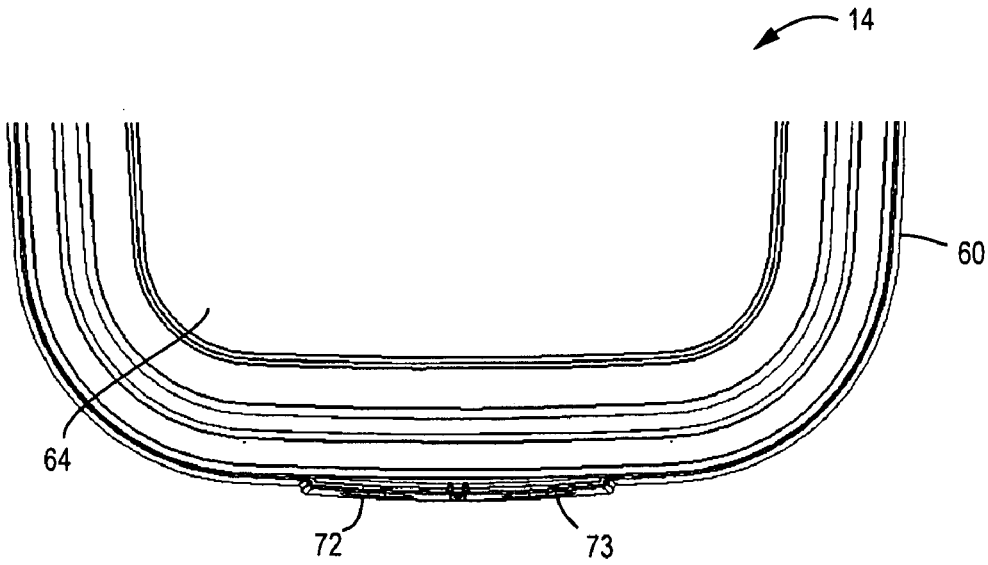
FIG. 8 is a partial top planar view of the closure of FIG. 1.

Referring to FIG. 7, tear strip 70 terminates in a pair of starting tabs (e.g., finger pull, pull tab, starting point, flap, etc.), shown as a first pull tab 72 and a second pull tab 73. First pull tab 72 and second pull tab 73 are generally rectangular members that each define an aperture (e.g., opening, recess, etc.) configured to receive a finger of a user or some other object. As shown best in FIGS. 7 and 8, first pull tab 72 and second pull tab 73 are generally parallel to the adjacent portions of tear strip 70, but are outwardly offset from side wall 60 and the rest of tear strip 70. Such a configuration advantageously draws the attention of the user to first pull tab 72 and second pull tab 73 thereby making it easier upon a user to locate the starting point of tear strip 70. Such a configuration further increases the amount of clearance between a back surface of first pull tab 72 and second pull tab 73 and the outer surface of pail 12. This additional clearance may provide additional space for a user to get his or her finger behind first pull tab 72 and/or second pull tab 73 thereby simplifying the removal of trip strip 70 for the user.

Tear strip 70 is formed as a single unitary body with cover 14 and is coupled to side walls 60 by a relatively thin web of material or tear line wall 74. According to the embodiment illustrated, tear line wall 74 provides a substantially continuous transition between side walls 60 and tear strip 70. According to the various alternative embodiments, tear line wall 74 may be discontinuous (e.g., intermittent, etc.) along the periphery of cover 14. To facilitate the coupling of first pull tab 72 relative to second pull tab 73, first frangible link 75 and second frangible link 76 are provided. First frangible link 75 provides a substantially continuous transition (i.e., a continuous edge following substantially the same line) between an upper edge of first pull tab 72 and an upper edge of second pull tab 73. Second frangible link 76 provides a substantially continuous edge between a lower edge of first pull tab 72 and a lower edge of second pull tab 73. According to the embodiment illustrated, first frangible link 75 and second frangible link 76 provide for a substantially straight horizontal transition.

Additional frangible links 77 may be provided to couple first pull tab 72 and second pull tab 73 to side wall 60 to further reduce the likelihood of trip strip 70 being inadvertently removed. Frangible links 77 extend substantially perpendicular between side wall 60 and the upper edge of first pull tab 72 and the upper edge of second pull tab 73 to secure first pull tab 72 and second pull tab 73 relative to side wall 60. Any number of frangible links 77 may be provided. According to the embodiment illustrated, two frangible links 77 are used, one at each pull tab.

Figure 9A:
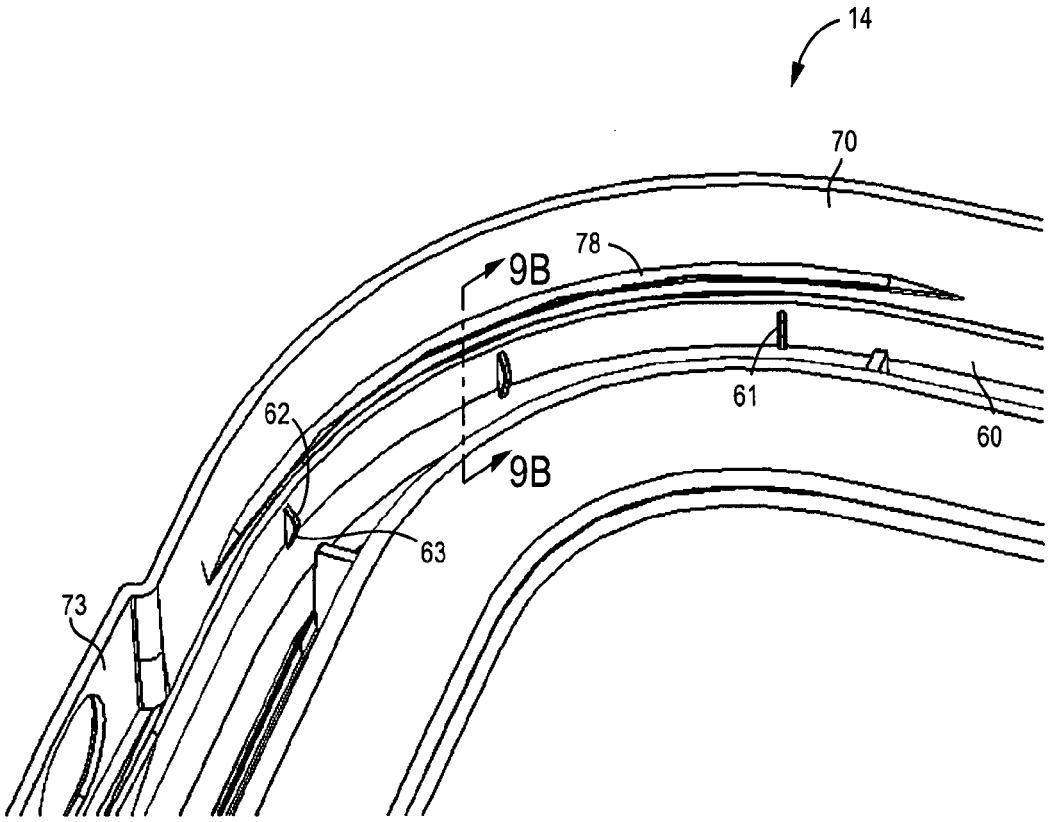
FIG. 9A is a detailed partial perspective view of the closure of FIG. 1 showing the inside of the closure.
Figure 9B:
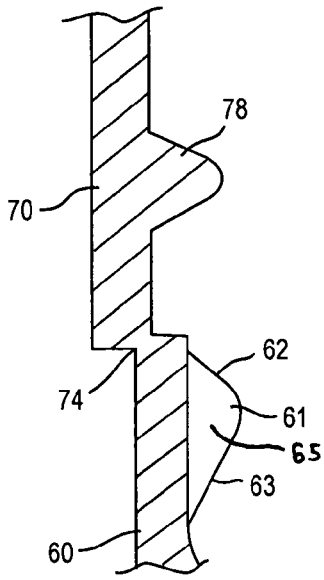
FIG. 9B is a partial cross section of the closure of FIG. 9A taken along line 9B-9B showing protrusions extending inward from the side wall of the closure.

Referring to FIG. 9A, the corners of tear strip 70 are shown as including projections 78. Projections 78 extend inward from the inside surface of tear strip 70 and in a generally horizontal direction. Projections 78 are configured to engage projections 44 on pail 12, when cover 14 is coupled to pail 12, as described in more detail below. Projections 78 are shown as being provided only in the corners of tear strip 70, but alternatively may be provided continuously around tear strip 70 or along only one or more sides of tear strip 70.

To remove tear strip 70, the user inserts a finger (or other object) into at least one of first pull tab 72 and second pull tab 73. This can be done by inserting the finger through the front of the pull tab, or by going under the lower edge of the pull tab and inserting the finger through the back of the pull tab. Once first pull tab 72 and/or second pull tab 73 is engaged by the user, the user pulls on the respective pull tab which tears the web of material 74 that couples tear strip 70 to side walls 60. First pull tab 72 and second pull tab 73 may be used independently of each other or a user may pull both first tab 72 and second pull tab 73 simultaneously in opposite directions. The offset and flared nature of first pull tab 72 and second pull tab 73 relative to side wall 60 and the angled upper surface 57 of lift handle 56 allow the user to readily insert a finger into the pull tabs and/or to grab the pull tabs. First frangible link 75 and second frangible link 76 provide a generally continuous contour on the upper and lower edges of first pull tab 72 and second pull tab 73 respectively and reduce the likelihood of first pull tab 72 and/or second pull tab 74 catching on something and tearing tear strip 70 from cover 14 prematurely. Once tear strip 70 has been removed, corner projections 44 and 78 are no longer engaged, making it easier to remove cover 14 from pail 12, allowing the user to freely open and close container 10.

When cover 14 is coupled to pail 12, side walls 60 of cover 14 and side walls 20 of pail 12 at least partially overlap. Referring further to FIG. 9A, a plurality of projections 61 are provided on the inside surface of side walls 60 near the corners of cover 14 to releasably couple cover 14 to pail 12 before and after tear strip 60 is removed. Projections 61 are vertical members (e.g., fins, ribs, catches, retainers, etc.) and are configured to engage lip 42 on pail 12, as described in more detail below. Projections 61 are defined by a pair of substantially planar side walls 65, a guide surface 62 and a retaining surface 63. Guide surface 62 functions as a guide (e.g., camming surface, etc.) when cover 14 is being applied to pail 12, while retaining surface 63 functions as a latching element to secure cover 14 to pail 12.

According to an exemplary embodiment (shown in FIG. 9B), projections 61 have a generally triangular profile and include a generally linear guide surface 62 and a generally linear retaining surface 63. According to the various alternative embodiments, one or more of guide surface 62 and retaining surface 63 may be a curved, polygonal or combinations thereof. When cover 14 is in an upright orientation (as shown in FIG. 5), guide surface 62 extends inward and upward relative to side wall 60 and retaining surface 63 extends inward and downward relative to side wall 60. According to an exemplary embodiment, the transition between guide surface 62 and retaining surface 63 is a curved surface to provide for a generally smooth transition between guide surface 62 and retaining surface 63.

While projections 61 are shown only in the corners of cover 14, projections 61 may be provided anywhere along the inside surface of side walls 60. For example, projections 61 may be spaced apart along the entire inside surface of side walls 60 or may be provided only along the straight portions. Further, while projections 61 are shown as being equally spaced apart from each other, projections 61 may be selectively positioned at varying locations along the inside surface. Projections 61 are being used in place of horizontal projections. As spaced-apart vertical members, projections 61 have certain advantages over horizontal projections used on the inside surface of covers. For example, it has been discovered that the use of vertical projections 61 reduces the amount of distortion (e.g., warping, etc.) realized by cover 14 when being cooled after cover 14 is formed via a molding process (relative to a cover with a horizontal projection). Further, it appears that less force is required to open cover 14 with vertical projections 61 than if the cover included a horizontal projection. This makes it easier for a user to open and close container 10.

According to the various alternative embodiments, vertical projections 61 may be used with a cover that does not include a removable tear strip. For example, vertical projections 61 may be used with a cover that is initially secured to a receptacle using a seal (e.g., plastic wrap, shrink wrap, etc.) that must be selectively removed by a user before opening the container. Similar to the embodiment described above, projections 61 may be provided continuously around the inside edge of the cover, or alternatively may be provided in various positions around the inside edge of the cover (e.g., only in the corners, etc.).

The corresponding features 61 and 78 provided on sidewalls 60 of cover 14 and features 42 and 44 provided on sidewalls 20 of pail 12 engage one another to retain cover 14 on pail 12. Retaining surfaces 63 of projections 61 on cover 14 engage lip 42 on pail 12 to couple pail 12 to cover 14. When tear strip 70 is coupled to cover 14, corner projections 44 on pail 12 engage corner projections 78 on tear strip to further couple to pail 12 to cover 14. This facilitates the coupling of cover 14 to pail 12 during shipping, transport, or other activities in which it may be more likely to unintentionally remove cover 14 from pail 12.

Figure 10:
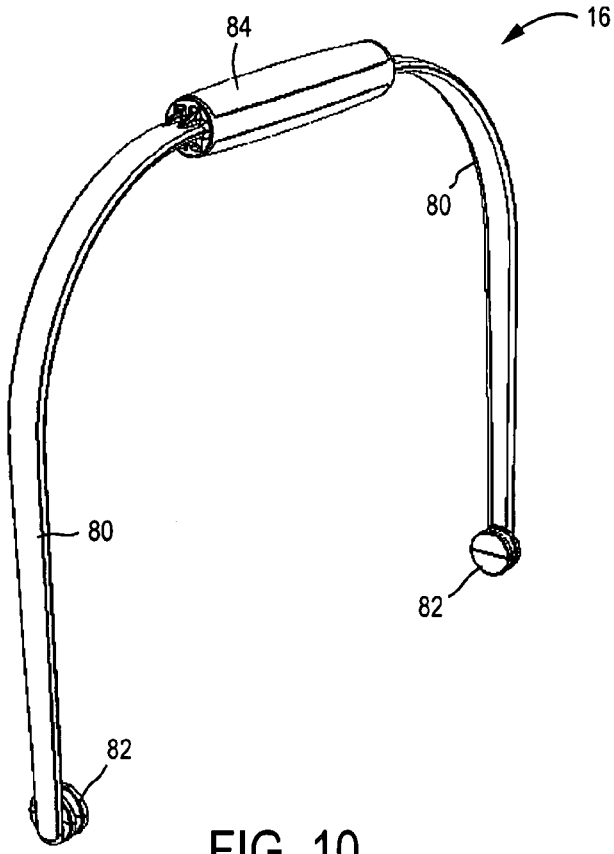
FIG. 10 is a perspective view of a handle according to an exemplary embodiment for use with a container.
Figure 11:
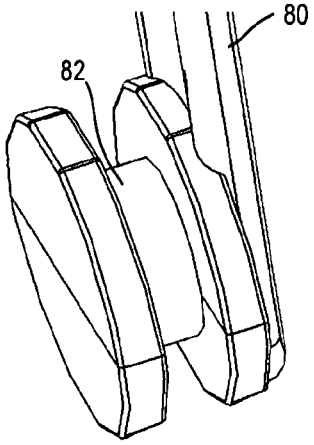
FIG. 11 is a detailed partial perspective view of the handle of FIG. 10.
Figure 12:
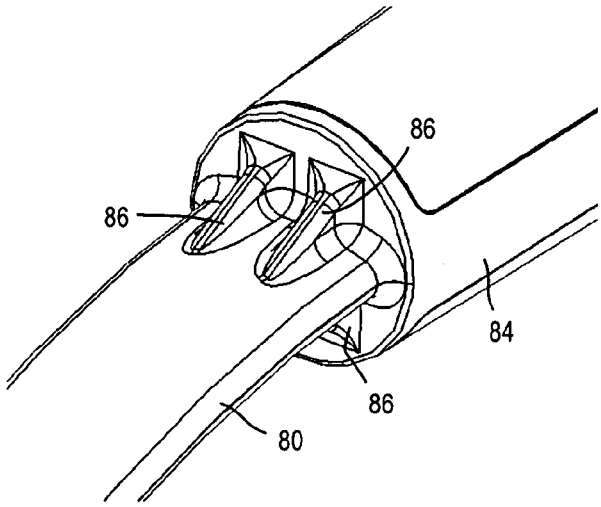
FIG. 12 is another detailed partial perspective view of the handle of FIG. 10.

Referring to FIGS. 10-12, handle 16 is shown according to an exemplary embodiment. Handle 16 generally includes a bail or strap portion 80 and a grip portion 84 disposed generally midway along strap portion 80. Strap portion 80 includes a first section and a second section that extend outward from opposite ends of grip portion 84. Each section terminates in an engaging portion 82 that couples handle 16 to pail 12. As shown best in FIG. 11, engaging portions 82 are generally circular members with an H-shaped cross-section that interface with recesses 50 on collar 40 (shown in FIG. 2). Engaging portions 82 are inserted through slots 52 and are received by circular openings 54. When received by circular openings 54, engaging portions 82 resist disengagement while still allowing handle 16 to rotate relative to pail 12.

Grip portion 84 is integrally formed with strap portion 80 and includes an outer gripping surface that provides a comfortable portion for a user to grasp handle 16. Grip portion 84 may also include an inner support structure that is substantially concealed by the outer grip surface. The inner support structure is a web-like structure (e.g., grid, etc.) that provides sufficient structural support grip portion 84. As shown best in FIG. 12, one or more support features 86 (e.g., ribs, gussets, braces, flanges, etc.) are provided between grip portion 84 and strap portion to strengthen and/or stiffen the joint between grip portion 84 and strap portion 82. According to an exemplary embodiment, strap portion 82 is a generally flat member. According to other exemplary embodiments, the strap portion may have a circular cross-section, square cross-section or any other suitable cross-section. According to various exemplary embodiments, an additional grip member may be coupled to handle 16 that is able to rotate relative to strap portion 80.

According to one exemplary embodiment, each of the closure, receptacle and handle is integrally-formed through a molding operation. According to various exemplary embodiments, the assemblies and components of the container, including the closure, the receptacle and the handle, may be constructed from one or more separate components assembled together and may be constructed from a variety of suitable materials, including various polymers and elastomers (e.g., plastics, rubbers, etc.). Each element of the container may be made from the same material, or the different portions of the container, such as the handle, for example, may made from a different material than the other elements of the container. According to alternative embodiments, other well known processes may be used to construct the container.

It is important to note that the construction and arrangement of the elements of the container as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, angles, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or other elements of the container may be varied, and the nature or number of the projections or recesses may be varied in size, shape and configuration. It should be noted that the elements and/or assemblies of the container may be constructed from any of a wide variety of materials that provide sufficient strength, durability, or flexibility, in any of a wide variety of colors, textures and combinations. It should also be noted that the container may be used in association with a variety of materials in a wide variety of different environments and situations. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

What is claimed is:

1. A container system comprising:

a closure, the closure comprising:

a top portion having an outer edge;

a skirt downwardly depending from the outer edge and having an inside surface and a lower edge;

a plurality of spaced apart projections supported at the inside surface of the skirt and extending in a substantially vertical direction, wherein the projections are configured to releasably engage an open end of the container for securing the to the container;

a removable tear strip provided at a lower edge of skirt and having at least one pull tab; and a container, the container comprising:

a side wall having an upper end and a lower end;

an end wall provided at the lower end of the side wall;

a satellite ring disposed around the upper end of the side wall, the satellite ring having a top surface configured to be vertically offset from a lower edge of the removable tear strip; and a lift handle formed into the satellite ring and configured to be positioned under the at least one pull tab of the removable tear strip, the lift handle having a top surface slanting inward towards the side wall, wherein a portion of the satellite ring is missing at the top surface of the lift handle to provide clearance for a user trying to grasp the at least one pull tab.

2. The container system of claim 1, wherein the projections include a guide surface for guiding the projections over the open end of the container and a retaining surface for retaining the projections on the container.

3. The container system of claim 2, wherein the guide surface extends inward and upward relative to the skirt and the retaining surface extends inward and downward relative to the skirt.

4. The container system of claim 3, wherein the guide surface and the retaining surface are substantially linear surfaces.

5. The container system of claim 4, wherein a curvilinear surface separates the guide surface from the retaining surface.

6. The container system of claim 2, wherein the projections further include a pair of substantially flat side walls.

7. The container system of claim 1, wherein the projections are spaced apart around the entire inner periphery of the skirt.

8. The container system of claim 1, wherein the is a substantially rectangular closure and the projections are only provided in one or more corner regions of the closure.

9. The container system of claim 1, wherein the is a substantially rectangular closure and the projections are only provided at one or more side regions of the closure.

10. The container system of claim 1, further comprising a tear strip removably coupled to the lower edge of the skirt.

11. The container system of claim 10, wherein the tear strip has an inside surface with at least one horizontal projection configured to engage a corresponding structure on the container.

12. The container system of claim 1, further comprising:

a tear strip removably coupled to the lower edge of the skirt, the tear strip having a first end and a second end;

first and second pull tabs, the first pull tab coupled to the first end of the tear strip, the second pull tab coupled to the second end of the tear strip; and at least one frangible link releasably coupling the first pull tab to the second pull tab, the at least one frangible link providing a substantially continuous transition between at least one of an upper edge of the first pull tab and an upper edge of the second pull tab and a lower edge of the first pull tab and a lower edge of the second pull tab, wherein the first and second pull tabs are offset outwardly from the skirt and the tear strip.

13. The container system of claim 12, wherein the at least one frangible link comprises a first frangible link and a second frangible link, the first frangible link providing a substantially continuous transition between the upper edge of the first pull tab and the upper edge of the second pull tab, the second frangible link providing a substantially continuous transition between the lower edge of the first pull tab and the lower edge of the second pull tab.

14. The container system of claim 13, further comprising third and fourth frangible links, the third frangible link extending between the skirt and the first pull tab, the fourth frangible link extending between the skirt and the second pull tab.

15. The container system of claim 12, wherein the first and second pull tabs each defining an aperture configured to receive the finger of a user.

16. The container system of claim 15, wherein each aperture is an oblong opening extending through the respective first and second pull tabs.

17. The container system of claim 12, wherein the closure is a substantially rectangular closure and the first and second pull tabs are centrally located on a front side of the closure.

18. The container system of claim 12, wherein a portion of the skirt substantially above the first and second pull tabs is slightly offset relative to the remaining portions of the skirt to provide visual guidance towards an intended lift point for removing the closure from the container after the tear strip has been removed.

19. The container system of claim 1, further comprising a handle, the handle comprising:

a bail;

a gripping portion integrally formed with the bail, the gripping portion having an inner support structure and an outer gripping surface substantially concealing the inner support structure; and at least one stiffening projection extending between the bail and the gripping portion.

20. A container for use with a closure having a removable tear strip with at least one pull tab, the container comprising:

a side wall having an upper end and a lower end;

an end wall provide at the lower end of the side wall;

a satellite ring disposed around the upper end of the side wall, the satellite ring having a top surface configured to be vertically offset from a lower edge of the removable tear strip; and a lift handle formed into the satellite ring and configured to be positioned under the at least one pull tab of the removable tear strip, the lift handle having a top surface slanting inward towards the side wall, wherein a portion of the satellite ring is missing at the top surface of the lift handle to provide clearance for a user trying to grasp the at least one pull tab.

21. The container of claim 20, wherein the container is a rectangular pail having four corners.

22. The container of claim 21, further comprising a structural configuration in the corners to reduce the likelihood that the container will be crushed when stacked.

23. The container of claim 22, wherein the structural configuration are corrugations extending in a substantially vertical direction without passing the satellite ring.

24. The container of claim 21, further comprising at least one denesting projection in each inside corner of the container.

25. The container of claim 24, wherein the denesting projection comprises a pair of vertically extending ribs.

26. The container of claim 21, further comprises a recess on a bottom surface of the end portion configured to receive the fingers of user to assist the user when pouring product from the container.

27. The container of claim 20, further comprising a handle, the handle comprising:

a bail;

a gripping portion integrally molded with the bail as a one-piece member, the gripping portion having an inner support structure and an outer gripping surface substantially concealing the inner support structure; and at least one stiffening projection extending between the bail and the gripping portion.

28. The container of claim 27, wherein the bail includes a first bail section integrally molded with a first side of the gripping portion and a second bail section integrally molded with a second side of the gripping portion.

29. The container of claim 28, wherein both the first bail section and the second bail section include a first end integrally molded with the gripping portion and a second end configured to be coupled to a container.

30. The container of claim 29, wherein the second end is configured for rotational movement relative to the container.

31. The container of claim 30, wherein the bail is a substantially flat member and the gripping portion extends outward from the bail in a radial direction.

32. The container of claim 31, wherein the at least one stiffening projection comprises a plurality of ribs extending outward from the bail in a direction that is substantially perpendicular to the bail.

* * * * *